US010036284B2

(12) United States Patent
Balliel et al.

(10) Patent No.: US 10,036,284 B2
(45) Date of Patent: Jul. 31, 2018

(54) ROTATING GAS TURBINE BLADE AND GAS TURBINE WITH SUCH A BLADE

(71) Applicant: Ansaldo Energia Switzerland AG, Baden (CH)

(72) Inventors: Martin Balliel, Bassersdorf (CH); Frank Gersbach, Ehrendingen (CH); Stefan Andreas Retzko, Zürich (CH); Marco Lamminger, Ennetbaden (CH)

(73) Assignee: ANSALDO ENERGIA SWITZERLAND AG, Baden (CH)

( * ) Notice: Subject to any disclaimer, the term of this patent is extended or adjusted under 35 U.S.C. 154(b) by 369 days.

(21) Appl. No.: 14/963,927

(22) Filed: Dec. 9, 2015

(65) Prior Publication Data

US 2016/0169052 A1 Jun. 16, 2016

(30) Foreign Application Priority Data

Dec. 16, 2014 (EP) ..... 14198306

(51) Int. Cl.

| | |
|---|---|
| ***F01D 25/32*** | (2006.01) |
| ***F01D 5/18*** | (2006.01) |
| ***F01D 5/22*** | (2006.01) |
| ***F01D 5/14*** | (2006.01) |

(52) U.S. Cl.

CPC ..... *F01D 25/32* (2013.01); *F01D 5/147* (2013.01); *F01D 5/18* (2013.01); *F01D 5/187* (2013.01); *F01D 5/225* (2013.01); *F05D 2220/32* (2013.01); *F05D 2230/211* (2013.01); *F05D 2240/305* (2013.01); *F05D 2240/307* (2013.01);

(Continued)

(58) Field of Classification Search

CPC . F01D 25/32; F01D 5/147; F01D 5/18; F01D 5/187; F01D 5/225

See application file for complete search history.

(56) References Cited

U.S. PATENT DOCUMENTS 5,837,019 A * 11/1998 Endres ..... F01D 25/32 55/404
7,097,419 B2 * 8/2006 Lee ..... F01D 5/081 415/115

(Continued)

FOREIGN PATENT DOCUMENTS

EP 1 731 710 A1 12/2006
EP 2 607 629 A1 6/2013

OTHER PUBLICATIONS

Search Report dated Jun. 1, 2015, by the European Patent Office for Application No. 14198306.4.

*Primary Examiner* — Igor Kershteyn
*Assistant Examiner* — Eric Zamora Alvarez
(74) *Attorney, Agent, or Firm* — Buchanan Ingersoll & Rooney PC

(57) ABSTRACT

A rotating gas turbine blade is disclosed which includes an airfoil with a suction side and a pressure side, the airfoil extending in a radial direction from a blade root to a blade tip. The blade tip includes a tip shroud, the airfoil having internal cooling passages for a cooling medium, which extend through the tip shroud. Outlet ports are provided above a selected internal airfoil cooling passage for the cooling medium to be ejected above the tip shroud in a direction of the blade's pressure side. Dust accumulation is avoided at the tip end of the selected internal cooling passage.

20 Claims, 3 Drawing Sheets

(52) U.S. Cl.
CPC .... *F05D 2260/20* (2013.01); *F05D 2260/607* (2013.01)

(56) References Cited

U.S. PATENT DOCUMENTS 7,654,795 B2 * 2/2010 Tibbott ..... F01D 5/187
415/115
2006/0275118 A1 12/2006 Lee

* cited by examiner

ROTATING GAS TURBINE BLADE AND GAS TURBINE WITH SUCH A BLADE

BACKGROUND OF THE INVENTION

The present invention relates to the technology of gas turbines. It refers to a rotating gas turbine blade according to the preamble of claim 1.

It further refers to a gas turbine with such a rotating gas turbine blade.

PRIOR ART

FIG. 1 shows in a perspective, partially sectioned view an exemplary gas turbine with sequential combustion, which is known as type GT26 gas turbine. The gas turbine 30 of FIG. 1 comprises a rotor 31, which bears a plurality of rotating gas turbine blades with different functions and rotates around a central machine axis. The rotor 31 is enclosed by a casing 32. Gas turbine 30 has at one end an air inlet 33, through which air enters a compressor 34 to be compressed. The compressed air is used to burn a fuel and is used as a cooling medium for various parts of the gas turbine 30, which are exposed to high temperatures. As exemplary gas turbine 30 is designed as a reheat turbine with sequential combustion, there are two combustors 35 and 37 arranged along the machine axis. Hot gas generated in first combustor 35 drives a high pressure (HP) turbine 36. The hot gas, which exits high pressure turbine 36 and still contains oxygen, is used to burn fuel in second combustor 37. The reheated gas from second combustor 37 drives a low pressure (LP) turbine 38.

Especially low pressure turbine 38 is equipped with rotating gas turbine blades with a tip shroud (used primarily to reduce over-tip leakage flow and coupling between blades), which are often cooled with one or more internal passages within the airfoil. However, the pumping work on the flowing cooling medium from centrifugal force is not or insufficiently used to provide additional driving force for the rotor 31 by ejecting the cooling medium against the blade's rotating direction.

Document EP 2 607 629 A1 discloses a rotating gas turbine blade with improved cooling air outlet ports for increase in efficiency/power. It uses an improved outlet port, which provides a direction of the cooling medium having a tangential component parallel to the rotating direction for recovery of pumping power.

However, dust present in the cooling medium or from the supply system may accumulate at the tip end and negatively affect cooling medium flow as well as add mass at the tip end, which may negatively affect the blade's life time. Document EP 2 607 629 A1 is silent with regard to a dust accumulation problem.

SUMMARY OF THE INVENTION

It is an object of the present invention to provide a rotating gas turbine blade, which is advantageous over the prior art blades, especially with regard to the degrading flow of cooling medium through the internal airfoil cooling passages.

This object is obtained by a rotating gas turbine blade according to claim 1.

The rotating gas turbine blade according to the invention comprises an airfoil with a suction side and a pressure side, said airfoil extending in a radial direction from a blade root to a blade tip, wherein said blade tip comprises a tip shroud, said airfoil comprises internal cooling passages for a cooling medium, which extend through said tip shroud, and outlet ports are provided above a selected internal airfoil cooling passage for said cooling medium to be ejected above said tip shroud against the direction of the blade rotation.

It is characterized in that means for avoiding dust accumulation are provided at the tip end of said selected internal cooling passage.

According to an embodiment of the invention said means for avoiding dust accumulation comprises dust holes extending in radial direction from said selected internal cooling passage to the outside above said tip shroud.

Specifically, said internal cooling passages have been produced by a casting process using a core, which is held in position by so-called core exits and the holes generated by said core exits are used as said dust holes.

According to another embodiment of the invention said outlet ports have been machined into said tip shroud.

Specifically, said outlet ports are oriented such that said cooling medium is ejected against the rotating direction of the blade.

More specifically, in said outlet ports a turning of the internal flow from upwards along the blade's longitudinal direction is provided by a curved shape and a minimum guiding length towards the desired direction.

Even more specifically, said guiding length is increased by inserting a tube into the machined opening and holding the tube in position by bonding, especially brazing or welding, and/or a mechanical interlock.

According to just another embodiment of the invention said tip shroud is provided with two or more fins extending parallel to each other on the upper side of said tip shroud in circumferential direction, interspaces are defined between neighbouring of said fins, elevated areas are provided in said interspaces, and said outlet ports and said means for avoiding dust accumulation are disposed in said elevated areas above the internal cooling passages.

The gas turbine according to the invention comprises a rotor with a plurality of rotating gas turbine blades. It is characterized in that at least some of these rotating gas turbine blades are rotating gas turbine blades according to the invention.

BRIEF DESCRIPTION OF THE DRAWINGS

The present invention is now to be explained more closely by means of different embodiments and with reference to the attached drawings.

DETAILED DESCRIPTION OF DIFFERENT EMBODIMENTS OF THE INVENTION

Figure 1:
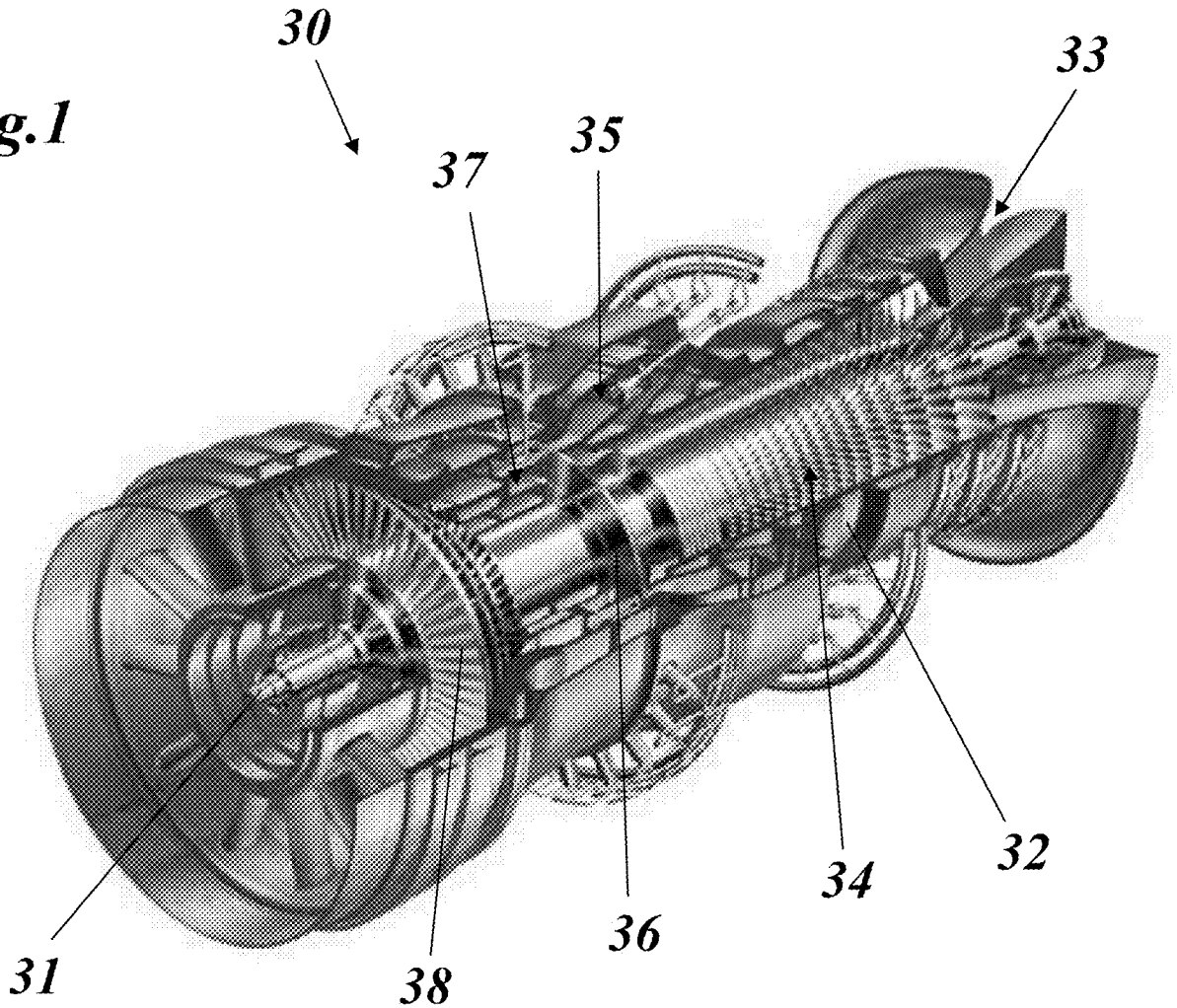
FIG. 1 shows in a perspective view a gas turbine of the type GT24/26 with sequential combustion, which may be equipped with the blades according to the invention.
Figure 2:
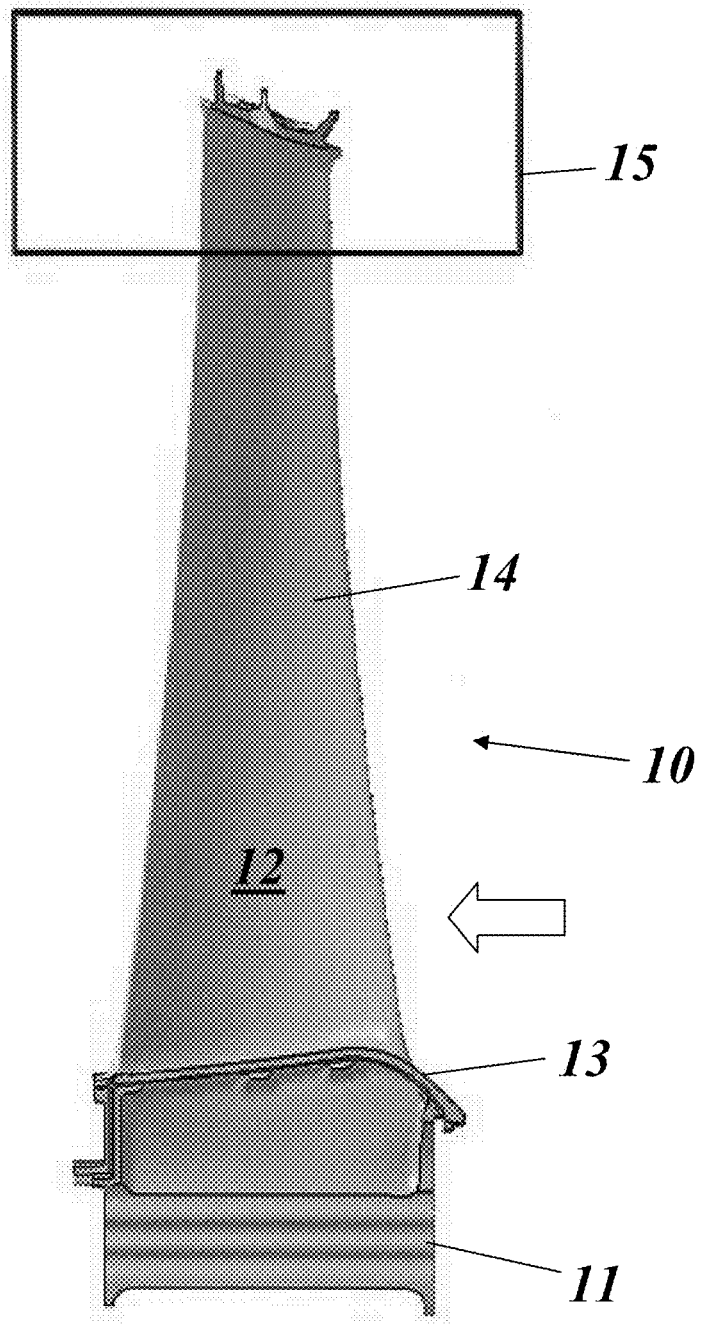
FIG. 2 shows in a side view a rotating gas turbine blade on the pressure side according to an embodiment of the invention.

FIG. 2 shows in a side view a rotating gas turbine blade according to an embodiment of the invention. The turbine blade 10 of FIG. 2 comprises an airfoil 14, which extends in radial direction (with regard to the machine axis of the gas turbine) from a blade root 11 (with a fir tree configuration)

to a shrouded blade tip 15. A platform 13 defines an inner wall of the annular hot gas channel between rotor 31 and casing 32. Airfoil 14 has a leading edge and a trailing edge (with regard to hot gas flow; see arrow in FIG. 2) as well as a suction side and a pressure side. The pressure side 12 is facing the viewer, in this case.

Figure 3:
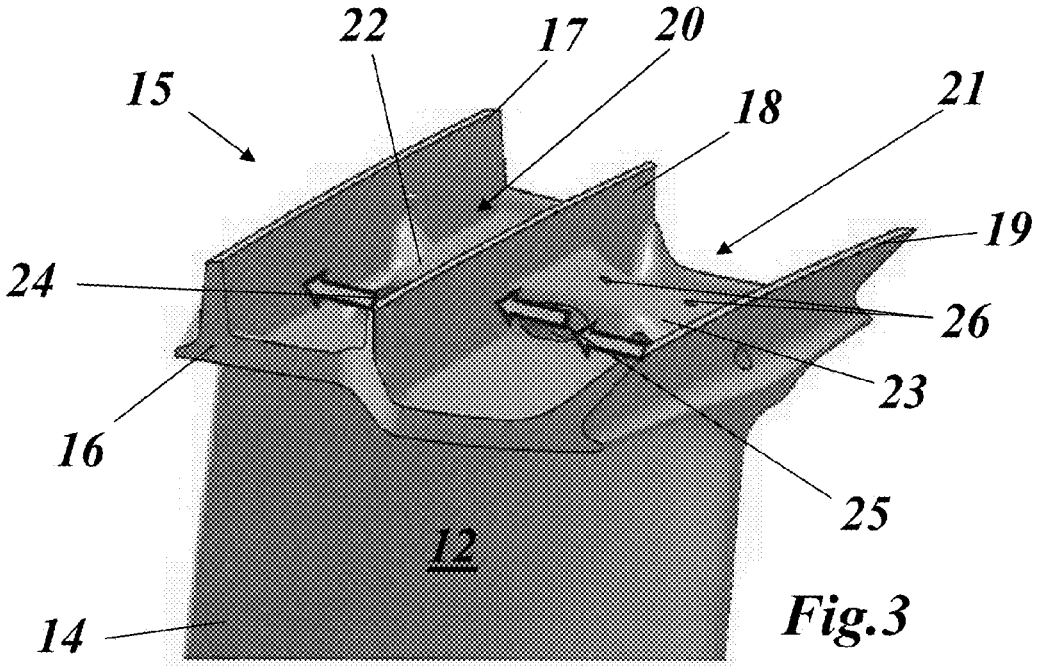
FIG. 3 shows in a magnified view the tip and tip shroud of the blade according to FIG. 2.

As can be seen in FIG. 3, blade tip 15 comprises a tip shroud 16, which is part of a partially closed or closed ring when all blades of the same turbine stage are mounted on rotor 31. Tip shroud 16 comprises on its upper (outer) side three parallel fins 17, 18 and 19, which extend along a circumferential direction. Neighbouring fins 17, 18 and 18, 19 define an interspace 20 and 21, respectively. Cooling medium (e.g. compressed air) is ejected into these interspaces 20, 21 through outlet ports 24 and 25. The cooling medium is supplied through the interior of the airfoil 14 by means of internal cooling passages 27 and 28 (see FIG. 4). An additional cooling passage (not shown) feeds outlet port 24.

Figure 4:
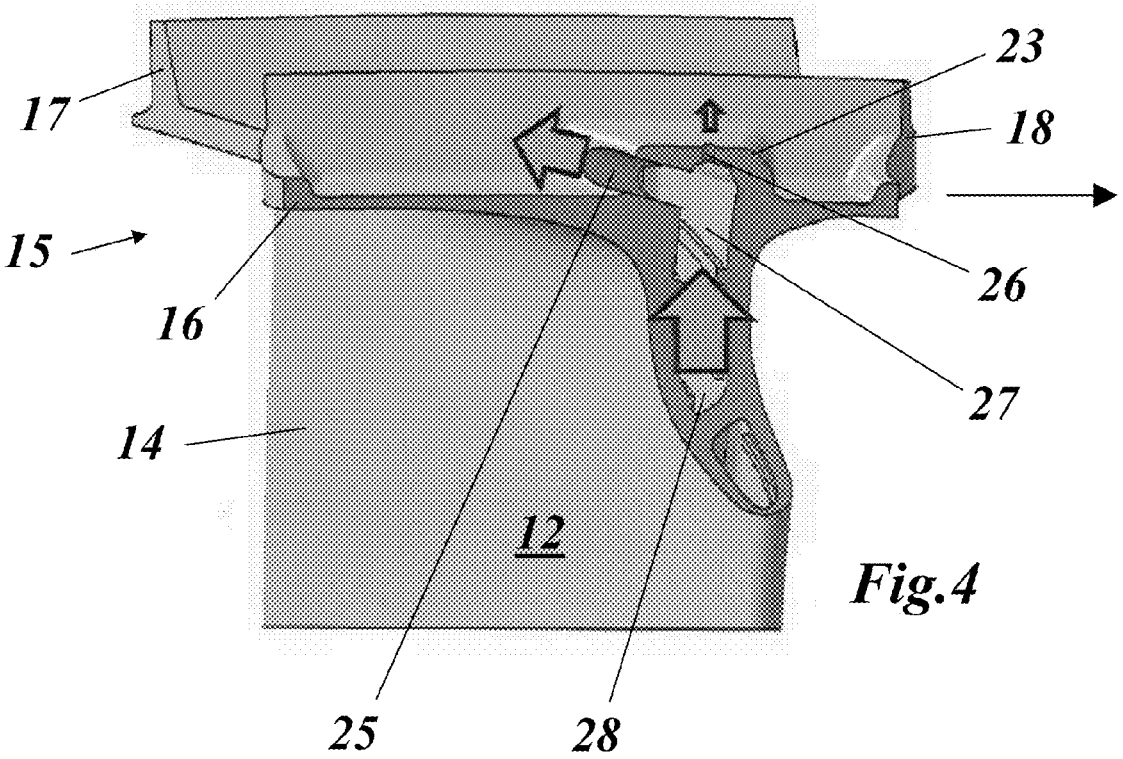
FIG. 4 shows a partial section of the tip shroud of FIG. 3 on the leading edge of the blade

Thus, for rotating gas turbine blade 10 with tip shroud 16 and one or more internal cooling passages 27, 28 in the airfoil 14, there are provided above said shroud 16 one or more outlet ports 24, 25 for cooling medium (e.g. air) to be ejected with a significant component in direction of the blade's pressure side 12 through a machined opening to increase gas turbine efficiency and power due to the resulting additional driving force for the rotor (which rotates in the direction of the right arrow in FIG. 4).

The position of the outlet ports 24, 25 is selected above an internal airfoil cooling passage 27 and not above any possible solid webs. This has the advantage that core exits through the tip shroud 16 can be used as dust holes 26 to avoid dust accumulations at the tip end of an internal cooling passage 27, which may negatively affect the flow of cooling medium and add mass at the tip shroud, which may negatively affect the blade (a core is used to produce the internal passages during a casting process and requires holding in position by so-called core exits, which connect the core to the mould).

Ideally, the cooling medium is ejected through outlet ports 24, 25 aligned with the rotating direction of the blade, so a turning of the internal flow from upwards along the blade's longitudinal direction (due pressure margin above the external hot gas pressure, largely from centrifugal force) is provided by a curved shape (to decrease turning losses) and a minimum guiding length towards the desired direction (to increase the component of the flow aligned with the desired direction).

The guiding length can be increased by inserting a tube into the machined opening and holding the tube in position by bonding, e.g. by brazing or welding, and/or a mechanical interlock.

The outlet ports 24, 25 and dust holes 26 are preferably arranged in an elevated area 22, 23 within the interspaces 20 and 21.

LIST OF REFERENCE NUMERALS

10 turbine blade
11 blade root
12 pressure side
13 platform
14 airfoil
15 blade tip
16 tip shroud
17,18,19 fin
20,21 shroud cavity
22,23 elevated area
24,25 outlet port
26 dust hole
27,28 cooling passage
30 gas turbine
31 rotor
32 casing
33 air inlet
34 compressor
35,37 combustor
36 high pressure (HP) turbine
38 low pressure (LP) turbine

The invention claimed is:

1. A rotating gas turbine blade, comprising:

an airfoil with a suction side and a pressure side, said airfoil extending in a radial direction from a blade root to a blade tip, wherein said blade tip includes a tip shroud, said airfoil having internal cooling passages for a cooling medium, which extend through said tip shroud, and outlet ports are provided above a selected internal airfoil cooling passage for said cooling medium to be ejected above said tip shroud in a direction of the blade's pressure side, said tip shroud is provided with two or more fins extending in parallel to each other on an upper side of said tip shroud in a circumferential direction, and interspaces are defined between neighboring of said fins, wherein holes for avoiding dust accumulation are provided at a tip end of said selected internal cooling passage, and wherein said interspaces are provided with elevated areas, and said outlet ports and said holes for avoiding dust accumulation are disposed in said elevated areas.

2. The rotating gas turbine blade as claimed in claim 1, wherein said holes for avoiding dust accumulation extend in a radial direction from said selected internal cooling passage to an outside above said tip shroud.

3. The rotating gas turbine blade as claimed in claim 2, wherein said internal cooling passages are cast in a core, which is held in position by core exits, which connect the core to a mould through said tip shroud, and holes generated by said core exits are said dust holes.

4. The rotating gas turbine blade as claimed in claim 1, wherein said outlet ports are machined ports in said tip shroud.

5. The rotating gas turbine blade as claimed in claim 4, wherein said outlet ports are oriented such that said cooling medium will be ejected with a significant component in a rotating direction of the blade.

6. The rotating gas turbine blade as claimed in claim 5, wherein in said outlet ports a turning of an internal flow from upwards along the blade's longitudinal direction is provided by a curved shape towards a desired direction.

7. A gas turbine, comprising:

a rotor with a plurality of rotating gas turbine blades, wherein at least one of these rotating gas turbine blades are rotating gas turbine blades according to claim 1.

8. The rotating gas turbine blade as claimed in claim 1, wherein the two or more fins comprises three parallel fins, which extend along the circumferential direction.

9. The rotating gas turbine blade as claimed in claim 1, wherein the cooling medium is compressed air.

10. The rotating gas turbine blade as claimed in claim 1, wherein the tip shroud of the rotating gas turbine blade is part of a partially closed or closed ring when each of the plurality of rotating gas turbine blades of a same turbine stage are mounted on the rotor.

11. A gas turbine, comprising:

a rotor with a plurality of rotating gas turbine blades, each of the plurality of rotating gas turbine blades having an airfoil with a suction side and a pressure side, said airfoil extending in a radial direction from a blade root to a blade tip, wherein said blade tip includes a tip shroud, said airfoil having internal cooling passages for a cooling medium, which extend through said tip shroud, and outlet ports are provided above a selected internal airfoil cooling passage for said cooling medium to be ejected above said tip shroud in a direction of the blade's pressure side, said tip shroud is provided with two or more fins extending in parallel to each other on an upper side of said tip shroud in a circumferential direction, and interspaces are defined between each of said fins, and elevated areas within each of said interspaces, and wherein holes for avoiding dust accumulation are provided at a tip end of said selected internal cooling passage and extend in a radial direction from said selected internal cooling passage to an outside above said tip shroud, and wherein said outlet ports and said holes for avoiding dust accumulation are disposed in said elevated areas.

12. The gas turbine as claimed in claim 11, wherein said internal cooling passages are cast in a core, which is held in position by core exits, which connect the core to a mould through said tip shroud, and holes generated by said core exits are said dust holes.

13. The gas turbine as claimed in claim 11, wherein said outlet ports are machined ports in said tip shroud.

14. The gas turbine as claimed in claim 11, wherein said outlet ports are oriented such that said cooling medium is ejected with a significant component in a rotating direction of the blade.

15. The gas turbine as claimed in claim 14, wherein in said outlet ports a turning of an internal flow from upwards along the blade's longitudinal direction is provided by a curved shape towards a desired direction.

16. The gas turbine as claimed in claim 11, wherein the two or more fins comprises three parallel fins, which extend along the circumferential direction.

17. The gas turbine as claimed in claim 11, wherein the cooling medium is compressed air.

18. The gas turbine as claimed in claim 11, wherein the tip shroud of each of the plurality of rotating gas turbine blades is part of a partially closed or closed ring when each of the plurality of rotating gas turbine blades of a same turbine stage are mounted on the rotor.

19. The gas turbine as claimed in claim 11, wherein each of the plurality of rotating gas turbine blades has a fir tree configuration.

20. The gas turbine as claimed in claim 11, further comprising:

a casing, the casing configured to enclose the rotor and the plurality of rotating gas turbine blades.

* * * * *